US005775345A

United States Patent [19]

Chou

[11] Patent Number: 5,775,345

[45] Date of Patent: Jul. 7, 1998

[54] HAIR CLIP

[76] Inventor: Kuo-Hua Chou, No. 17, Alley 10, Lane 118, Su-Wei Rd., Wu-Ku Hsiang, Taipei County, Taiwan

[21] Appl. No.: 880,650

[22] Filed: Jun. 23, 1997

[51] Int. Cl.[6] ..... A45D 8/22

[52] U.S. Cl. ..... 132/278; 24/555; 24/556; 24/563; D28/39

[58] Field of Search ..... 132/276, 277, 132/278, 280, 279, 281, 284, 282, 259, 245, 247, 253, 260, 283; 24/555, 556, 573.1, 563, 3.11; D28/39, 40

[56] References Cited

U.S. PATENT DOCUMENTS

| | | | |
|---|---|---|---|
| D. 135,820 | 6/1943 | Lundquist | D28/40 |
| 562,690 | 6/1896 | Young | 132/280 |
| 1,135,672 | 4/1915 | Decker | 132/280 |
| 1,280,281 | 10/1918 | Newdall | 132/281 |
| 1,375,504 | 4/1921 | Grable | 132/260 |
| 2,795,233 | 6/1957 | Zore | 132/276 |
| 3,076,465 | 2/1963 | Solomon | 132/283 |
| 3,837,350 | 9/1974 | Terrell et al. | 132/279 |
| 4,011,639 | 3/1977 | Koleske | 132/276 |
| 5,566,690 | 10/1996 | Shih-Ming | 132/276 |

FOREIGN PATENT DOCUMENTS

| | | | |
|---|---|---|---|
| 686785 | 1/1953 | United Kingdom | 132/280 |

*Primary Examiner*—Todd E. Manahan
*Assistant Examiner*—E. Robert
*Attorney, Agent, or Firm*—Morton J. Rosenberg; David I. Klein; Jun Y. Lee

[57] ABSTRACT

A hair clip has two curved arms connected in parallel and a clamping strip extending from a connecting area between the curved arms. Each curved arm has a pair of horizontally outwardly arched sections, a horizontally inwardly curved section connected between the horizontally outwardly arched sections, and a coupling tip at a free end. The clamping strip has a retainer portion at its free end for securing the coupling tips of the curved arms together. The clamping strip also has a plurality of downwardly curved sections and upwardly curved sections alternatively connected in a line between the clamping strip fixed end and free end. The width of the clamping strip is broader than the gap between the horizontally inwardly arched sections of the curved arms.

4 Claims, 7 Drawing Sheets

HAIR CLIP

BACKGROUND OF THE INVENTION

The present invention relates to hair clips, and more particularly to such a hair clip which is comprised of horizontally curved side arms connected in parallel, and a vertically curved clamping strip extended from the connecting area between the side arms and having a retainer portion at its free end for securing the free ends of the side arms together.

FIGS. 11 and 12 show a hair clip (3) according to the prior art, which is integrally made from a metal plate by stamping, having two side arms (31) and a clamping strip (32) suspended between the side arms (31). The side arms (31) have a respective free end (33) connected to each other by a knob (34). The clamping strip (32) has a middle part (321) curved inwards. When fastened to the hair (2), the free end of the clamping strip (32) is stopped against the bottom side of the connected free ends (33) of the side arms (31). This structure of hair clip is still not satisfactory in function. Because the clamping strip (32) is secured to the side arms (31) simply by stopping its free end against the bottom side of the connected free ends (33) of the side arms (31), the clamping strip (32) tends to trip out of position. Another drawback of this structure of hair clip is that the hair (2) tends to be pulled away from the clamping space between the bottom sides of the side arms (31) and the top side of the clamping strip (32).

SUMMARY OF THE INVENTION

The present invention has been accomplished to provide a hair clip which eliminates the aforesaid drawbacks. It is one object of the present invention to provide a hair clip which provides a high clamping force for fastening the hair. It is another object of the present invention to provide a hair clip which does not slip from the hair when installed. It is still another object of the present invention to provide a hair clip which is safe in use and does not hurt the head when fastened to the hair. According to one aspect of the present invention, the hair clip comprises two curved arms connected in parallel and a clamping strip extended from the connecting area between the curved arms, wherein each curved arm has a pair of horizontally outwardly arched sections, a horizontally inwardly curved section connected between the horizontally outwardly arched sections, and a coupling tip at its free end; the clamping strip has a retainer portion at its free end adapted for securing the coupling tips of the curved arms together, and a plurality of downwardly curved sections and upwardly curved sections alternatively connected in a line between its fixed end and its free end; the width of the clamping strip is broader than the gap between the horizontally inwardly arched sections of the curved arms. According to another aspect of the present invention, raised portions may be made on the curved arms at the bottom side or the clamping strip at the top side for holding down the hair. According to still another aspect of the present invention, a coil spring may be mounted around the clamping strip to act with the curved arms for fastening the hair.

DETAILED DESCRIPTION OF THE PREFERRED EMBODIMENT

Figure 1:
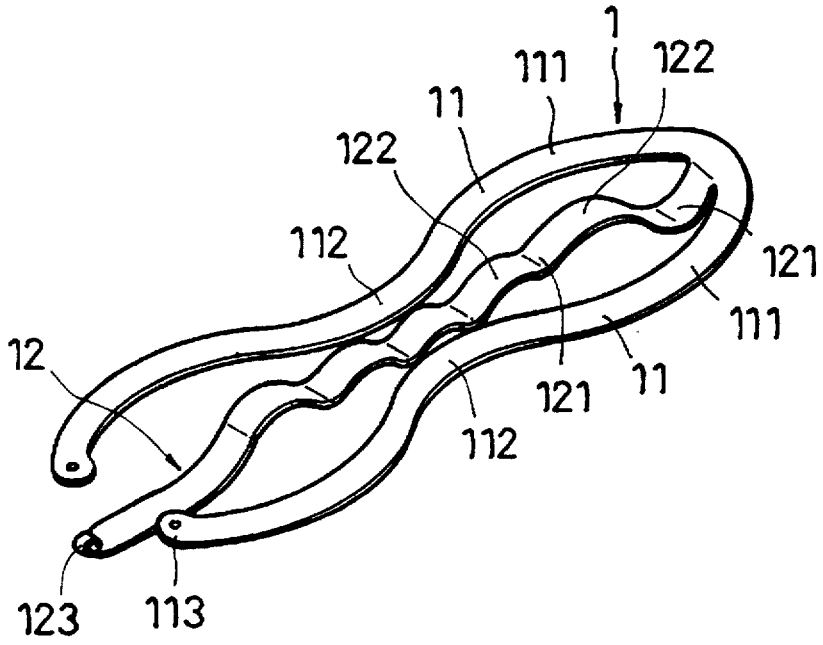
FIG. 1 is an elevational view of a hair clip according to a first embodiment of the present invention when unfastened.
Figure 2:
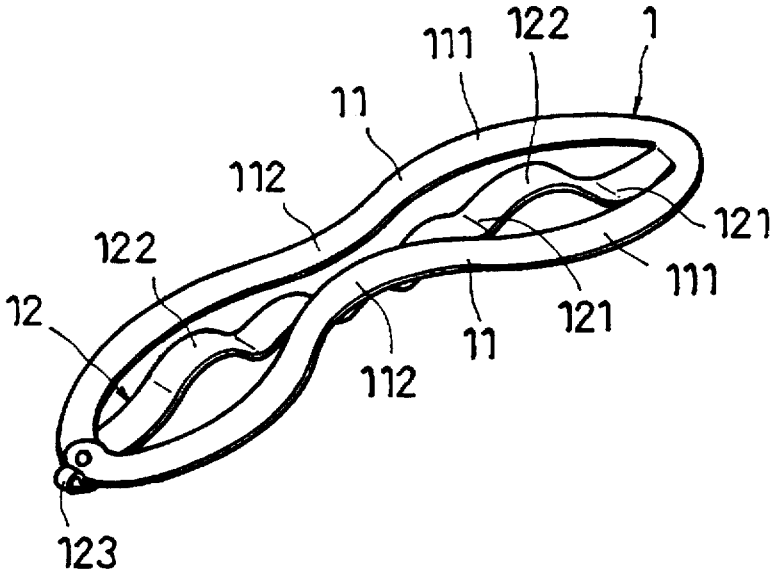
FIG. 2 is another elevational view of the first embodiment of the present invention, showing the hair clip fastened up.
Figure 3A:
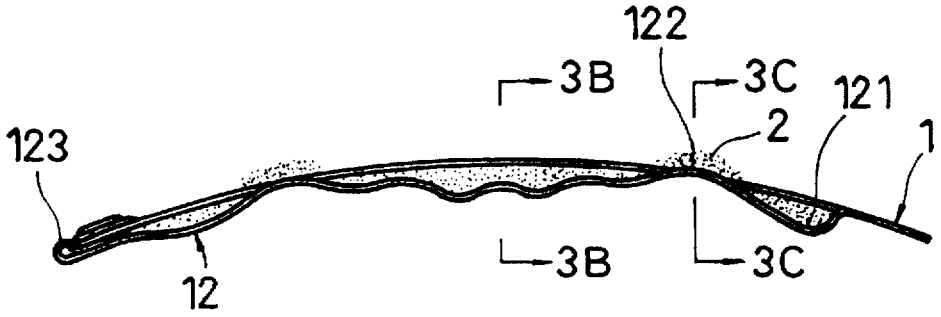
FIG. 3A is a side view in section of the first embodiment of the present invention, showing the hair clip fastened to the hair.
Figure 3B:
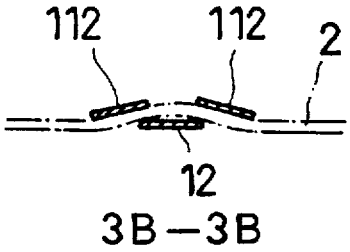
FIG. 3B is a sectional view taken along line A—A of FIG. 3A.
Figure 3C:
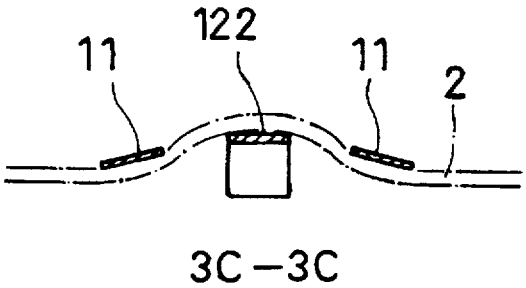
FIG. 3C is a sectional view taken along line B—B of FIG. 3A.
Figure 4:
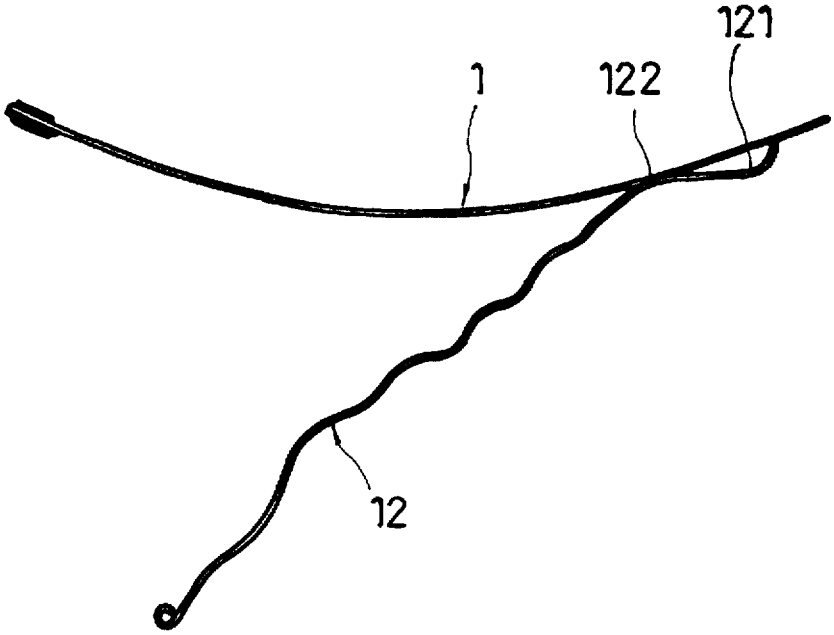
FIG. 4 is another side view in section of the first embodiment of the present invention, showing the clamping strip turned downwards from the curved arms.

Referring to FIGS. 1, 2, 3A, 3B, 3C and 4, the hair clip, referenced by 1, comprises two curved arms 11 connected into an open loop, and a clamping strip 12 extended from the connected area between the curved arms 11 and suspended between them. The curved arms 11 comprise a respective fixed end connected to each other, a respective free end terminating to a coupling tip 113, a respective pair of horizontally outwardly arched sections 111 disposed between the respective fixed end and the respective free end, and a respective horizontally inwardly arched section 112 connected between the respective pair of horizontally outwardly arched sections 111. The gap between the horizontally inwardly arched sections 112 of the curved arms 11 is narrower than the width of the clamping strip 12. The clamping strip 12 comprises a fixed end connected to the fixed ends of the curved arms 11, a free end terminating in a retainer portion 123, and a plurality of downwardly curved sections 121 and upwardly curved sections 122 alternatively connected in a line between its fixed end and its free end. When the coupling tips 113 of the curved arms 11 are coupled together, the retainer portion 123 of the clamping strip 12 is fastened to the coupling tips 113 of the curved arms 11 to hold them firmly together. When the retainer portion 123 of the clamping strip 12 is fastened to the coupling tips 113 of the curved arms 11, the upwardly curved sections 122 partially projecting into gaps between the curved arms 11 over the elevation of the curved arms 11, and the middle part of the clamping strip 12 is stopped below the horizontally inwardly arched sections 112 of the curved arms 11, therefore the hair 2 can be firmly retained in between the curved arms 11 and the clamping strip 12.

Figure 5:
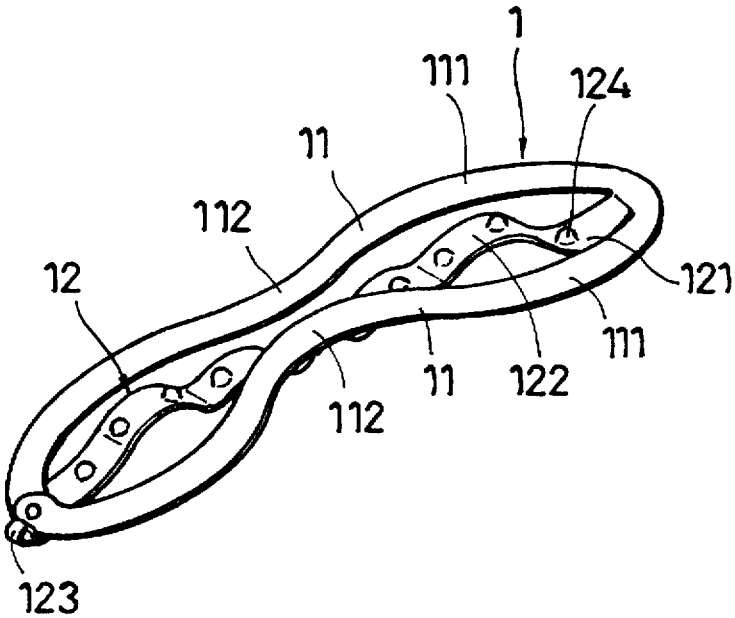
FIG. 5 is an elevational view of a hair clip according to a second embodiment of the present invention.

FIG. 5 shows an alternate form of the hair clip. According to this alternate form, the clamping strip 12 has a longitudinal row of raised portions 124 raised from a top side thereof.

Figure 6:
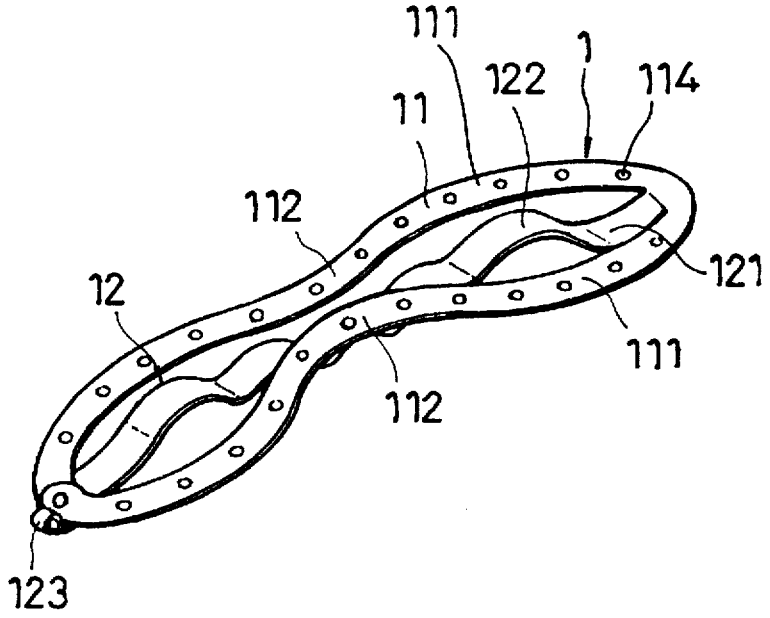
FIG. 6 is an elevational view of a hair clip according to a third embodiment of the present invention.
Figure 7:
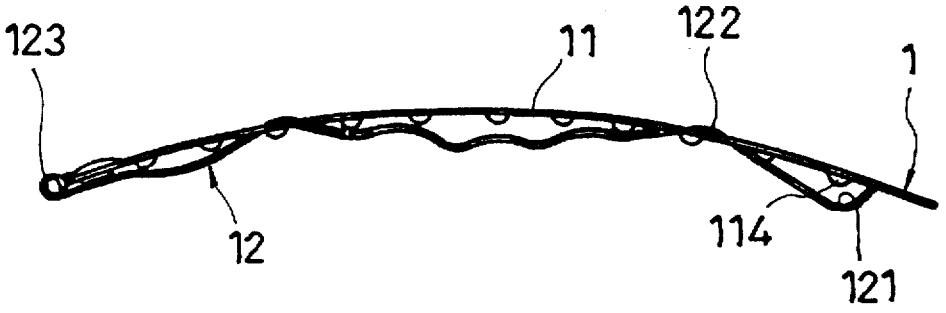
FIG. 7 is a side view in section of the third embodiment of the present invention.

FIGS. 6 and 7 show another alternate form of the hair clip. According to this alternate form, each curved arm 11 has a longitudinal row of raised portions 114 raised from a top side thereof for holding down the hair.

Figure 8:
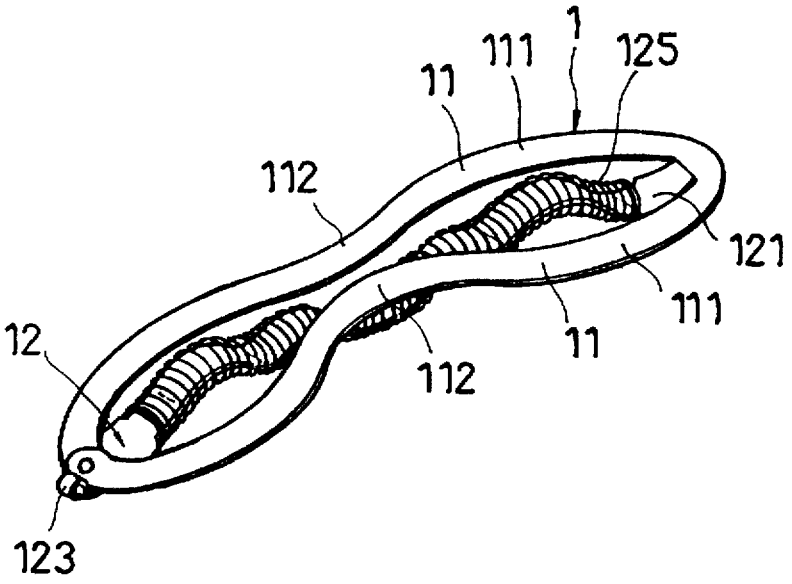
FIG. 8 is an elevational view of a hair clip according to a fourth embodiment of the present invention.
Figure 9:
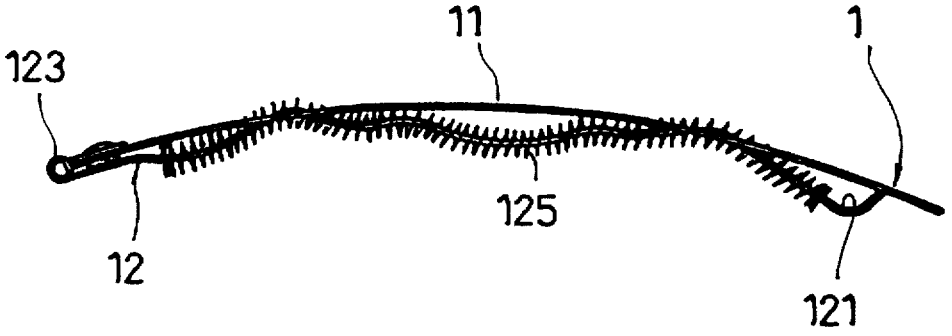
FIG. 9 is a side view in section of the fourth embodiment of the present invention.
Figure 10:
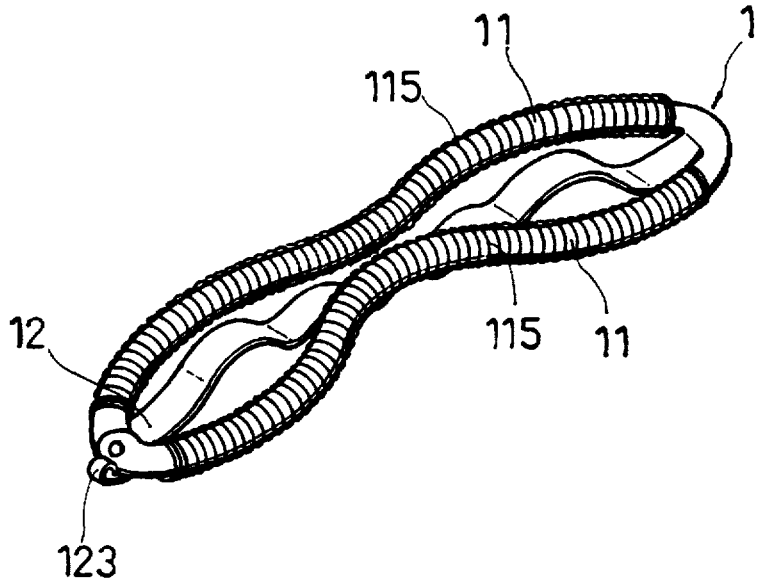
FIG. 10 is an elevational view of a hair clip according to a fifth embodiment of the present invention.
Figure 11:
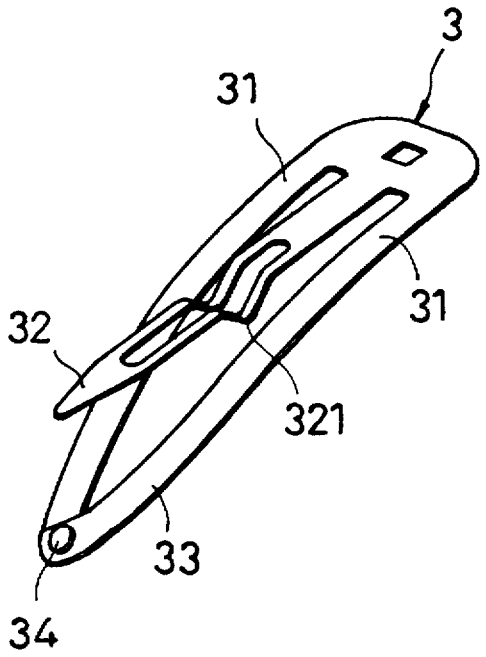
FIG.11 PRIOR ART
FIG. 11 is an elevational view of a hair clip according to the prior art.
Figure 12:
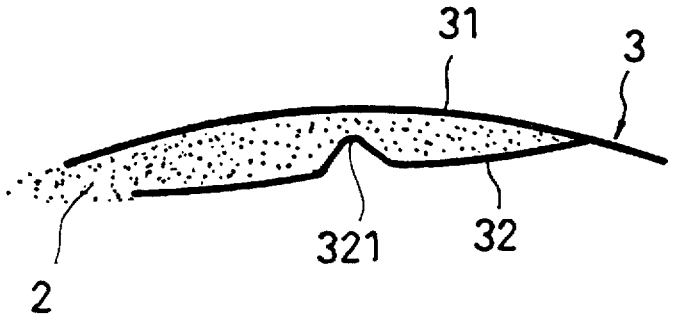
FIG.12 PRIOR ART
FIG. 12 is a side view in section showing the prior art hair clip of FIG. 11 fastened to the hair.

FIGS. 8 and 9 show still another alternate form of the hair clip. According to this alternate form, a coil spring 125 is mounted around the clamping strip 12 for acting with the curved arms 11 to fasten the hair.

It is to be understood that the drawings are designed for purposes of illustration only, and are not intended as a definition of the limits and scope of the invention disclosed.

What the invention claimed is:

1. A hair clip comprising two curved arms each; having a respective fixed end connected to each other and a respective free end releasably secured to each other, each of said curved arms comprising a pair of horizontally outwardly arched sections connected between its free end the horizontally inwardly curved sections of said arms forming a gap therebetween; and its fixed end, a horizontally inwardly curved section connected between said horizontally outwardly arched sections, and a coupling tip at its free end, and a clamping strip suspended between said curved arms, said clamping strip comprising a fixed end extending from the connected fixed ends of said curved arms, a free end terminating in a retainer portion releasably securing the coupling tips of said curved arms together, and a plurality of downwardly curved sections and upwardly curved sections alternatively connected in a line between its fixed end and its free end, said clamping strip having a width broader than the gap between the horizontally inwardly arched sections of said curved arms.

2. The hair clip of claim 1, wherein said clamping strip has a longitudinal row of raised portions raised from a top side thereof.

3. The hair clip of claim 1, wherein said curved arms have a respective longitudinal row of raised portions raised from a respective top side for holding down the hair.

4. The hair clip of claim 1 further comprising a coil spring mounted around said clamping strip for acting with said curved arms to fasten the hair.

* * * * *